United States Patent [19]

Beard

[11] 4,154,467

[45] May 15, 1979

[54] PANEL MOUNTED EXTERIOR KEYED LOCK FOR SLIDING DOOR AND WINDOWS

[76] Inventor: Eugene R. Beard, 3186 Reva Dr., Concord, Calif. 94519

[21] Appl. No.: 841,920

[22] Filed: Oct. 13, 1977

[51] Int. Cl.[2] ..... E05C 3/16

[52] U.S. Cl. ..... 292/251

[58] Field of Search ..... 70/97; 292/301, 251, 292/DIG. 46, DIG. 39

[56] References Cited

U.S. PATENT DOCUMENTS

| | | | |
|---|---|---|---|
| 1,571,574 | 2/1926 | Crossley | 292/251 |
| 2,018,346 | 10/1935 | Bushby | 291/251 X |
| 2,131,315 | 9/1938 | Dunseath | 292/DIG. 46 |
| 2,423,982 | 7/1947 | Kaufman | 70/97 |

*Primary Examiner*—Richard E. Moore

*Attorney, Agent, or Firm*—James R. Cypher

[57] ABSTRACT

A lock housing permanently mounted on a sliding panel houses a screw type lock. A keeper formed with a threaded opening is mounted on a fixed panel for registration with the threaded lock bolt in the closed panel position.

1 Claim, 5 Drawing Figures

PANEL MOUNTED EXTERIOR KEYED LOCK FOR SLIDING DOOR AND WINDOWS

BACKGROUND OF THE INVENTION

The sliding patio door has proved to be immensely popular in the past thirty years despite several obvious drawbacks. The standard patio door for example, cannot be locked from the outside, despite the fact that ingress and egress from such a door may be the most convenient access to the building. Further, such doors are extremely vulnerable to forced entry by burglars even when they are properly locked from the inside. Such doors may simply be lifted within their housing, pivotally swung outwardly and the entire door may be removed without forcing the lock.

Interior mounted door locks such as Sodenkamp, U.S. Pat. No. 3,709,539, Jan. 9, 1973 which are mounted on the floor prevent horizontal sliding of the movable panel, but they do not prevent entry if an illegal entry is performed by simply lifting the panel out of the frame as above described.

Robins, U.S. Pat. No. 3,886,771 provides secure exterior locking but the entire lock housing must be removed each time the door is unlocked. Imer, U.S. Pat. No. 3,863,470 provides exterior locking. The assembly is a lightweight "pop out" with an exposed lock cylinder barrel which can be easily twisted off with a common pipe wrench.

A more secure locked patio door is taught by Zelt, U.S. Pat. No 3,869,887 but the lock must be mounted inconveniently at the base of the door or in a hard to reach position at the very top of the door.

SUMMARY OF THE INVENTION

The gist of the present invention is the use of a screw type lock mounted on the exterior side of a sliding panel which has a threaded bolt which threadably registers with a keeper mounted on the non-sliding panel.

The lock of the present invention permits sliding doors and windows to be locked from the outside.

The lock of the present invention securely fastens both panels together so that neither can be removed from the frame when the lock is in the secured position.

The lock of the present invention may be mounted on existing standard patio doors with a minimum of modification and expense.

The lock of the present invention is invulnerable to forcing by a pipe wrench or pry bars. Further, even if a small panel of glass is cut in the glass door, there is no latch or other means to open the door. Entry can only be gained by breaking out the entire door.

DESCRIPTION OF THE INVENTION

Figure 1:
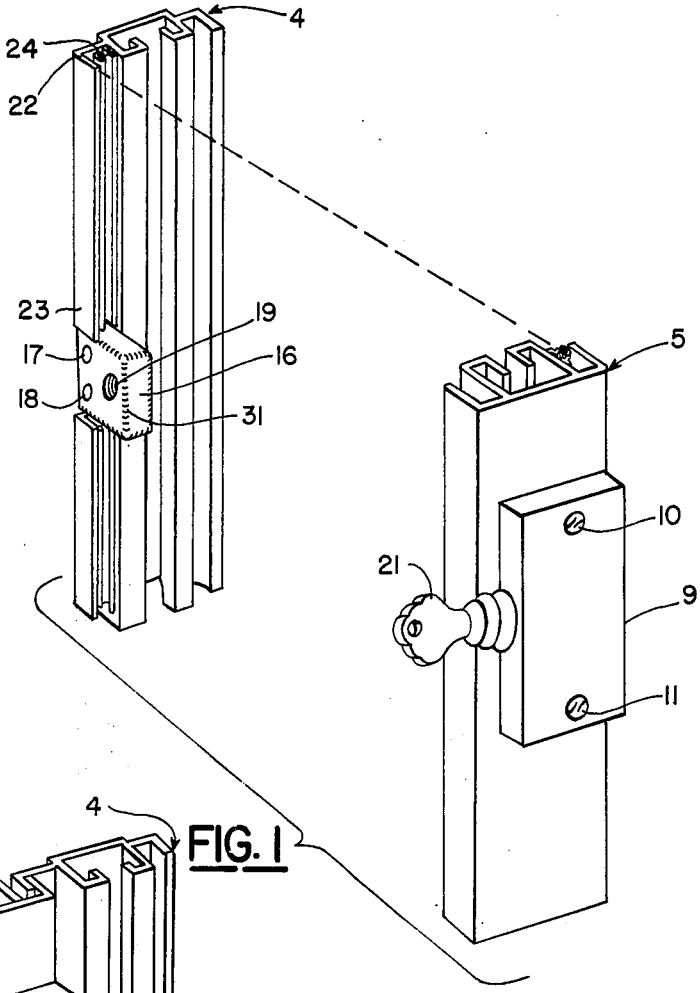
FIG. 1 is a perspective view of a portion of a sliding door or window in which the panels have been moved relative to each other to the open and unlocked position.

The present invention consists briefly of a lock 1 for use with a pair of overlapping closure panels 2 and 3, each having an overlapping frame member 4 and 5. At least one of the closure members is slidably mounted in tracks 7 and 8.

The lock consists of a lock housing 9 affixed to one of the overlapping frame members as by one-way screws 10 and 11. The housing is formed with an opening 12 therethrough dimensioned to receive a rotatable lock member 13. The lock member includes a threaded axially movable bolt 14 which is movable axially of the lock member.

A keeper member 16 is attached to the other of said overlapping frame members 14 as by screws 17 and 18. The keeper is formed with a threaded opening 19 and is positioned for threaded registration with the movable bolt.

Where the lock is to be mounted for locking from the inside only, the lock member may be simply provided with a finger engageable handle to rotate the threaded bolt. Where, however, the panels are to be locked from the outside, a key operable lock means is provided which can only be turned by a key 21. Such locks are commercially available and are known as screw type locks. Such locks are sometimes used on swinging vending machine doors.

Preferably, the lock housing is mounted on the movable panel member 2 and the keeper member is mounted on the immovable panel 3.

Figure 3:
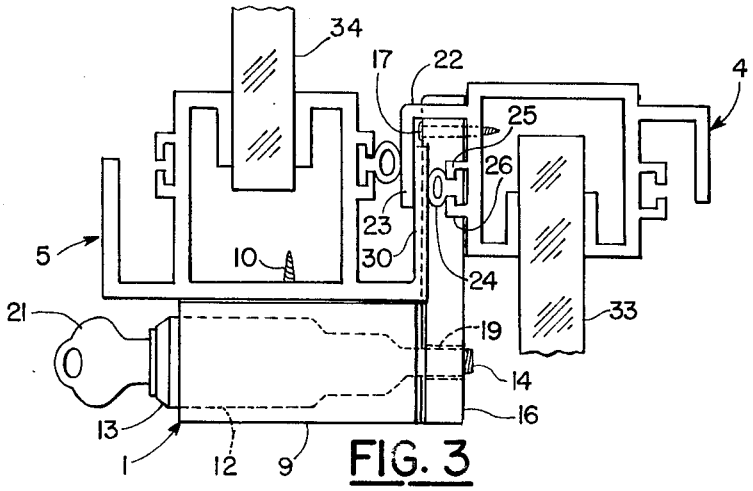
FIG. 3 is a cross sectional view of a portion of the sliding panels taken along line 3—3 of FIG. 4.
Figure 4:
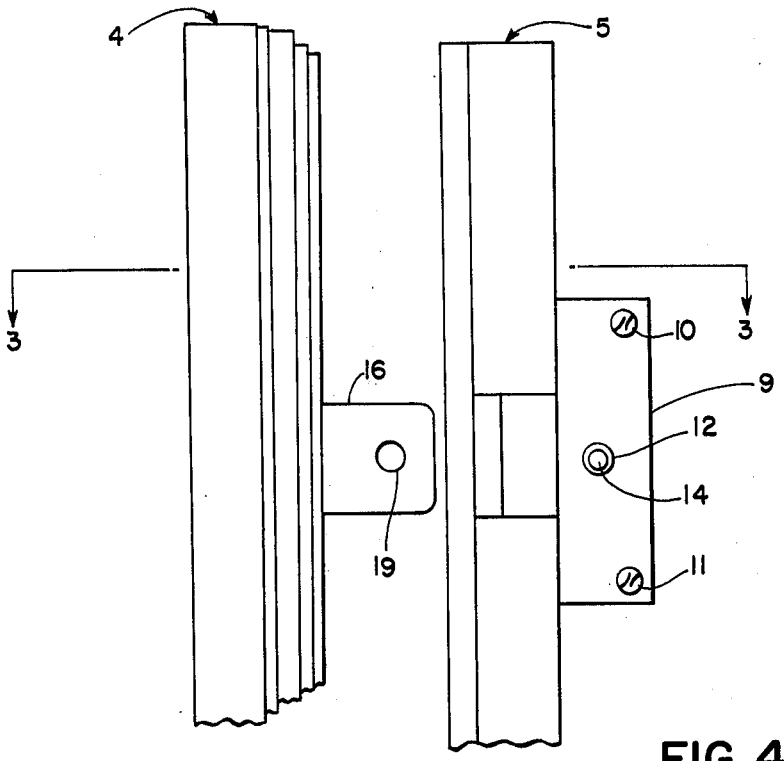
FIG. 4 is a side view of a portion of the panels shown in FIGS. 1-3.
Figure 5:
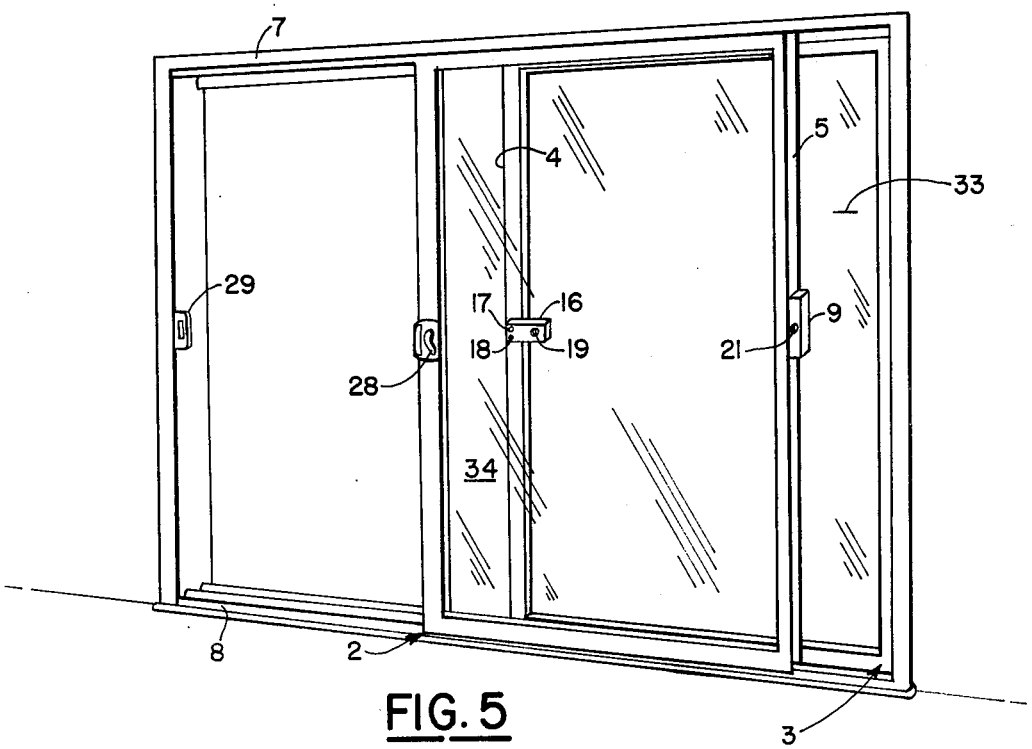
FIG. 5 is a perspective view of a sliding patio door or window with the lock of the present invention installed.

Installation of the lock means is best understood by referring to FIGS. 1, 3 and 5. Referring specifically to FIG. 1, the keeper is installed by first removing a section of flange members 22 and 23, sealing member 24 and sealing holding flanges 25 and 26. The keeper is then affixed to frame 4 by screws 17 and 18. Next, housing 9 is attached to frame 5 by one-way screws 10 and 11 in a position such that the threaded bolt 14 will match with the threaded opening 19 in the keeper member 16.

Preferably the lock housing is mounted at a convenient location on the frame such as the same elevation as the door handle 28 on patio doors. Where the door lock is mounted on sliding windows, a convenient location on the frame may be chosen.

Figure 2:
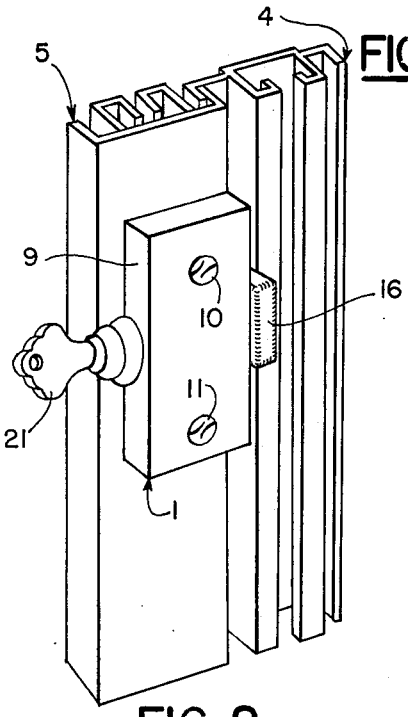
FIG. 2 is a perspective view of a portion of the sliding panels shown in FIG. 1 in the closed and lockable position.

Operation of the lock is as follows. The movable panel with handle member 28 and standard latch member 29 is moved from the open position as shown in FIG. 1 to the closed position shown in FIG. 2. Flange 30 on movable panel 5 moves into overlapping relation with the fixed panel between flange 23 and sealing member 24. As shown in FIG. 3, the threaded bolt is moved into registration with the threaded opening 19 in the keeper 16. The key 21 is rotated and the threaded bolt 14 moves axially into threaded registration with the opening in the keeper. To facilitate closure, leading edge 31 of the keeper is chamfered.

When the key is removed from the lock, the moving panel cannot be moved horizontally because the bolt is now securely attached to the keeper which is in turn attached to the keeper which is in turn attached to the fixed panel. Further, the movable panel cannot be moved vertically and lifted out of the frame because the panel is affixed to the immovable panel by the threaded bolt within the keeper member.

Finally, entry cannot be gained by cutting a small section of glass from the glass 33 of fixed panel or a small section of glass from the glass 34 of immovable panel. Without a key, the bolt cannot be rotated and thus access to the opposite side of the panels will not facilitate entry.

The lock cannot be forced by use of a pipe wrench since there is no way of grasping the rotatable member by the jaws of a wrench.

Entry can, of course, be gained by breaking out the entire panel of glass. Burglaries are seldom attempted in this manner, however, because the breaking glass generally attracts the attention of neighbors or security officers.

I claim:

1. A lock for use with a pair of closure panels each having a frame member formed with flanges which interlock upon closure and at least one of said panels is slidably mounted in a track; said lock comprising:

a. a lock housing affixed to said flange of said interlocking frame members and formed with an opening dimensioned to receive a rotatable lock member;

b. a lock member including a lock bolt mounted in said housing for rotatable and axial reciprocating movement having a threaded portion at one end and a manually engageable member at the other end;

c. a keeper mounted in a notch formed in said flanges of the other of said interlocking frame members and formed with a threaded opening for threaded registration with said movable bolt; and d. said flange on said panel holding said lock housing is formed with a notch for registration with said keeper when said panels are in the closed position to prevent relative vertical movement of said panels.

* * * * *

UNITED STATES PATENT AND TRADEMARK OFFICE

CERTIFICATE OF CORRECTION

PATENT NO. : 4,154,467

DATED : May 15, 1979

INVENTOR(S) : Eugene R. Beard

It is certified that error appears in the above-identified patent and that said Letters Patent are hereby corrected as shown below:

Column 2, line 62, delete [to the keeper which is in turn attached]

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*